United States Patent [19]

Joseph et al.

[11] Patent Number: 4,999,680

[45] Date of Patent: Mar. 12, 1991

[54] SUPPORT ASSEMBLY FOR MULTIPLE DEVELOPMENT STATIONS IN AN ELECTROSTATOGRAPHIC REPRODUCTION APPARATUS

[75] Inventors: Brian J. Joseph; Thomas W. Mort; Philip A. Stern, all of Rochester; Robert M. Westcott, Brockport, all of N.Y.

[73] Assignee: Eastman Kodak Company, Rochester, N.Y.

[21] Appl. No.: 336,391

[22] Filed: Apr. 11, 1989

[51] Int. Cl.[5] ..... G03G 15/01

[52] U.S. Cl. ..... 355/326; 118/645; 355/245

[58] Field of Search ..... 355/326, 327, 328, 245, 355/256; 118/645, 653, 659

[56] References Cited

FOREIGN PATENT DOCUMENTS

| | | | |
|---|---|---|---|
| 0121048 | 7/1983 | Japan | 355/326 |
| 0201371 | 10/1985 | Japan | 355/245 |
| 0097968 | 4/1988 | Japan | 355/326 |
| 0144370 | 6/1988 | Japan | 355/245 |
| 0080973 | 3/1989 | Japan | 355/326 |

OTHER PUBLICATIONS

Noboru et al., European Patent Application 0287122, Oct. 1988.

*Primary Examiner*—A. T. Grimley
*Assistant Examiner*—Robert Beatty
*Attorney, Agent, or Firm*—Lawrence P. Kessler

[57] ABSTRACT

A support assembly, in an electrostatographic reproduction apparatus having multiple development stations respectively containing different color marking particles for selective development of a plurality of latent image-wise charge patterns on a moving dielectric member so that such apparatus is capable of making multi-color reproductions. The support assembly includes a plurality of members adapted to receive the plurality of development stations respectively. The plurality of members are simultaneously movable to a first position where development stations received by the members are remote from the dielectric member to facilitate removal of such development stations from the apparatus, and to a second position where such development stations are in juxtaposition with the dielectric member. Additionally, the plurality of members, once in said second position where development stations received by the members are located to bring marking particles into development contact with the dielectric member, are independently movable to a third position where such development stations are located to prevent marking particles from coming into contact with the dielectric member.

7 Claims, 5 Drawing Sheets

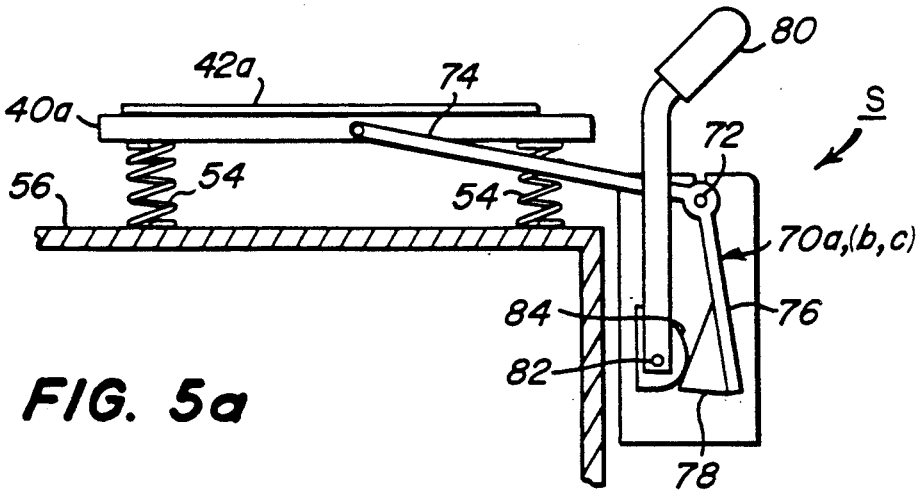
FIG. 5a
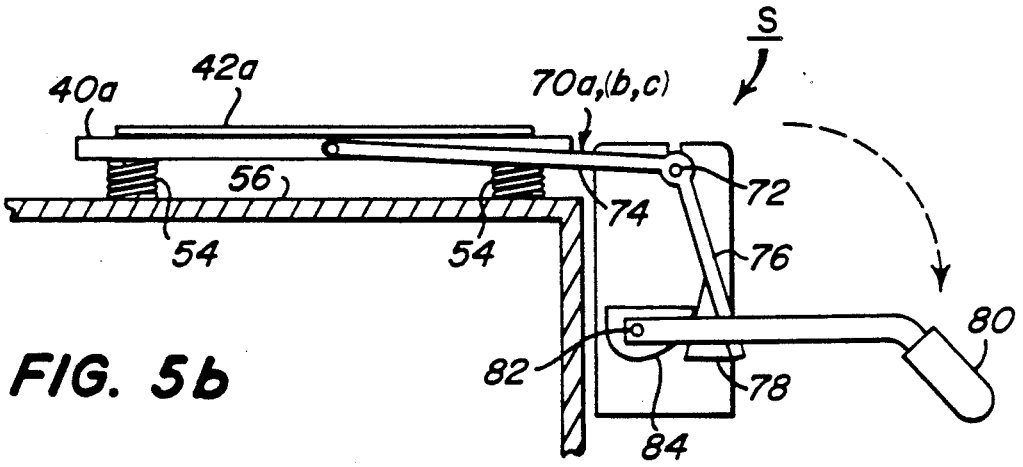
FIG. 5b
FIG. 7a
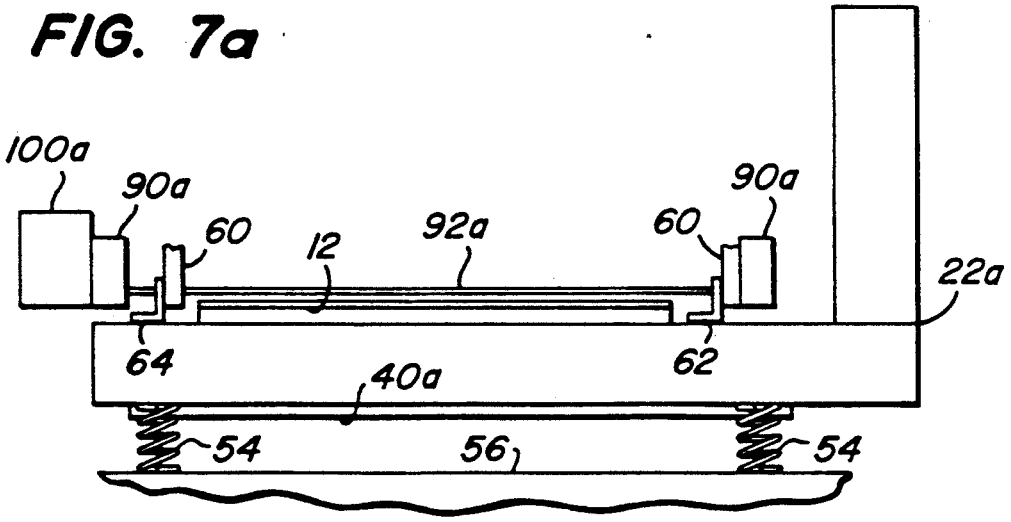

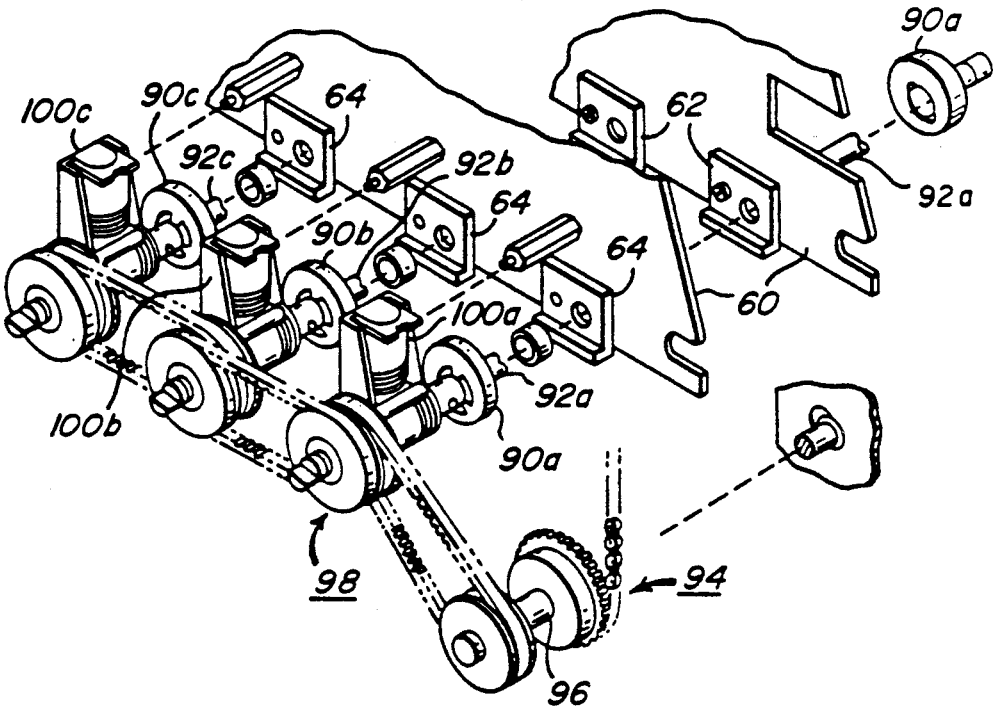
FIG. 6
FIG. 7b
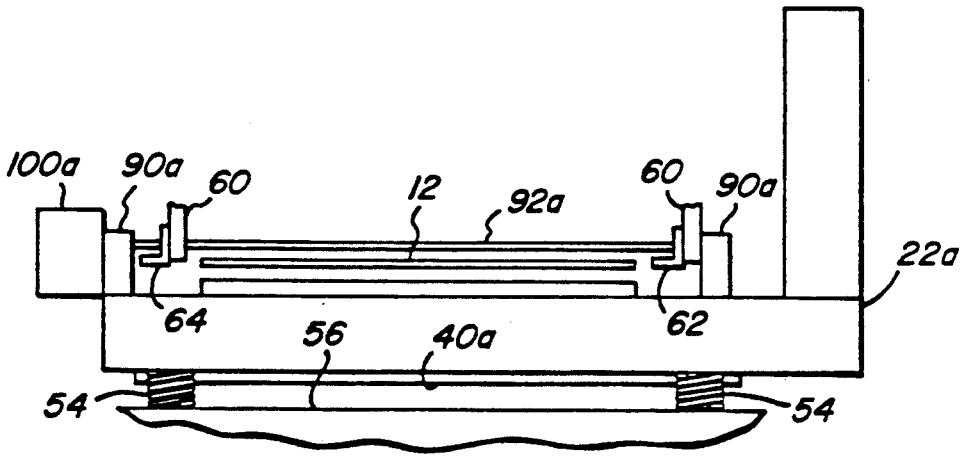

SUPPORT ASSEMBLY FOR MULTIPLE DEVELOPMENT STATIONS IN AN ELECTROSTATOGRAPHIC REPRODUCTION APPARATUS

BACKGROUND OF THE INVENTION

This invention relates in general to development stations for an electrostatographic reproduction apparatus, and more particularly to a support assembly for multiple development stations in an electrostatographic reproduction apparatus capable of making multi-color reproductions.

In typical electrostatographic reproduction apparatus, a charge pattern corresponding in image-wise fashion to original information to be reproduced is formed on a dielectric member. A development station containing electroscopic pigmented marking particles brings the particles into contact with the pattern to develop the pattern. The developed pattern is subsequently transferred and fixed to a receiver member to form the desired reproduction.

While electrostatographic reproduction apparatus generally reproduce information in monochrome, recently described apparatus are capable of reproducing information in multiple colors. Multi-color reproduction apparatus typically include a plurality of development stations respectively containing different colored marking particles. A plurality of charge patterns respectively corresponding to different color components of the original information to be reproduced are sequentially formed on the dielectric member. In proper order, the development stations are activated to respectively develop the charge patterns with appropriate color marking particles. The developed charge patterns are then transferred in superposition to a receiver member to form the multi-color reproduction.

Activation of the respective development stations may take place by selectively turning the stations on and off, or by moving the stations selectively into operative developing contact with the dielectric member. An exemplary mechanism for turning development stations on and off is shown in U.S. Pat. Nos. 4,131,357, issued Dec. 26, 1978, in the name of Forbes, 2nd, and 4,671,207, issued June 9, 1987, in the name of Hilbert. At high process speeds, complete shut off of the development nap within an appropriate time interval may be difficult to achieve. Moreover, complete removal of such developer stations from the reproduction apparatus without damage to the dielectric member may be difficult. U.S. Pat. No. 4,740,767, issued Apr. 26, 1988, in the name of Kawano et al, shows a plurality of developer stations selectively moved into contact with the dielectric member. The respective stations pivot to move into and out of contact with the dielectric member. As such the stations must be spaced from one another an appropriate distance to accommodate for the pivoting action. This results in an increase to the overall volume taken up by the development stations.

SUMMARY OF THE INVENTION

This invention is directed to a support assembly in an electrostatographic reproduction apparatus having multiple development stations respectively containing different color marking particles for selective development of a plurality of latent image-wise charge patterns on a moving dielectric member so that such apparatus is capable of making multi-color reproductions. The support assembly arrangement yields a compact size for the development stations, and facilitates rapid movement of the individual development stations into operative relation with the dielectric member and replacement of the individual development stations. The support assembly comprises a plurality of members adapted to receive the plurality of development stations respectively. The plurality of members are simultaneously movable to a first position where development stations received by the members are remote from the dielectric member to facilitate removal of such development stations from the reproduction apparatus, and to a second position where such development stations are in juxtaposition with the dielectric member. Additionally, the plurality of members, once in said second position where development stations received by the members are located to bring marking particles into development contact with the dielectric member, are independently movable to a third position where such development stations are located to prevent marking particles from coming into contact with the dielectric member.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which:

FIGS. 5*a* and 5*b* are side elevational views of the development station support assembly, showing the support assembly respectively in its position for supporting development stations in operative relation to the dielectric member and its lowered position for facilitating development station removal;

FIG. 6 is a view in perspective of the articulation mechanism of the development station support assembly;

FIGS. 7*a* and 7*b* are side elevational views respectively showing a development station supported by the development station support assembly in its development position and in its non-development position.

DESCRIPTION OF THE PREFERRED EMBODIMENT

Figure 1:
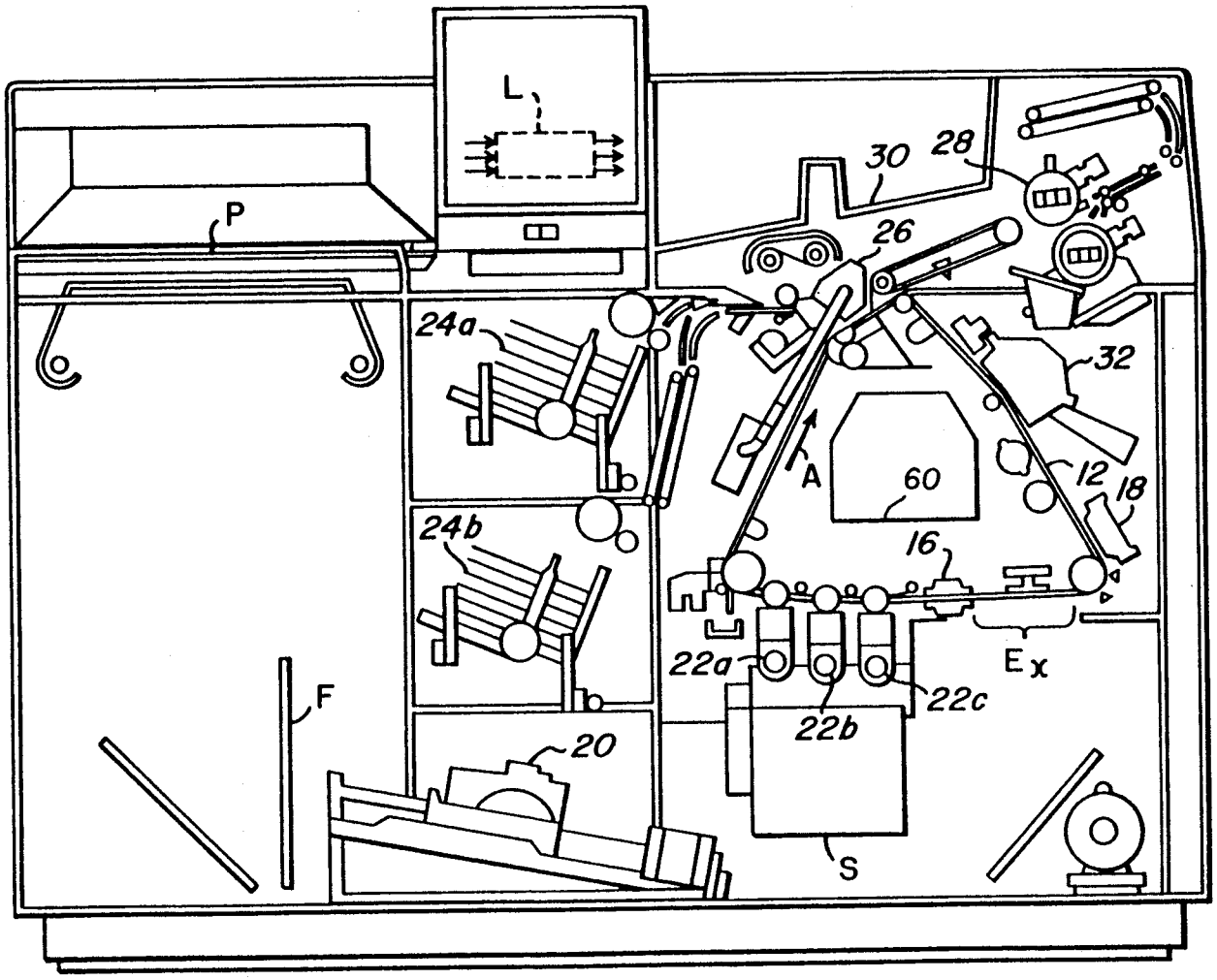
FIG. 1 is a front elevational view, partly in cross-section, of an exemplary electrostatographic reproduction apparatus including the development station support assembly according to this invention.

Referring now to the accompanying drawings, FIG. 1 shows an exemplary electrostatographic reproduction apparatus, designated by the numeral 10, employing a development station support assembly S according to this invention. The apparatus 10 includes an endless dielectric member (web 12) entrained about a plurality of rollers, one of which is driven by a suitable motor (not shown) to move the web 12 about a closed loop path in the direction of arrow A. The web 12 is, for example, a composite structure having a photoconductive surface layer with a plurality of successive image receiving areas and a grounded conductive support layer such as shown in U.S. Pat. No. 3,615,414 (issued Oct. 26, 1971 in the name of Light). Of course, other electrostatographic reproduction apparatus, such as those employing a photoconductive drum for example, are suitable for use with this invention.

Typical electrostatographic process stations are located about the periphery of the web 12 in operative relation with the image receiving areas of the web. Control of the electrostatographic process stations of the reproduction apparatus 10 is accomplished by a logic and control unit L including a microprocessor for example. The microprocessor receives operator input signals and timing signals, for example from sensor 16 detecting movement of the web 12 about its closed loop path. Based on such signals and a program for the microprocessor, the unit L produces signals to control the timing operation of the various electrostatographic process stations for carrying out the reproduction process. The production of a program for a number of commercially available microprocessors such as INTEL model 8080 or model 8085 microprocessor (which along with others are suitable for use with the invention), is a conventional skill well understood in the art. The particular details of any such program would, of course, depend on the architecture of the designated microprocessor.

The electrostatographic process stations function in the following manner to produce copies of multi-color information. A corona charger 18, coupled to a D.C. or biased A.C. electrical potential source (not shown), applies a uniform electrostatic charge to the web 12 as it moves past the charger. The uniform charge, in successive adjacent image receiving areas of the web, is altered as the web passes through zone $E_x$ to form respective latent image-wise charge patterns in such areas corresponding to images of the information to be copied. For example, color separation latent image-wise charge patterns are formed by exposure of the image-receiving area of the web to reflected light images of a multi-color document located on a transparent platen P, directed by lens 20 through respective color filters of filter wheel F. Of course, formation of image-wise charge patterns on the web may be alternately accomplished by other suitable methods such as by exposure to electronic (e.g. LED array or laser scanner) or electrostatic produced images. Further, with other electrostatographic reproduction apparatus which do not employ a photoconductive web, the formation of the latent image charge patterns need not be accomplished in successive image areas.

Travel of the web 12 brings the image receiving areas bearing the latent image-wise charge patterns into a development zone including a plurality of development stations 22*a*–22*c* mounted on the support assembly S according to this invention (to be more fully described hereinbelow). The development stations 22*a*–22*c* may be for example of the magnetic brush type such as described in U.S. Pat. No. 4,707,107, issued Nov. 17, 1987, in the name of Joseph, and respectively containing colored marking particles. If for example, the image-wise charge patterns correspond respectively to red, green, and blue color separation images, the colored marking particles in the respective development stations are cyan, magenta and yellow. Such marking particles exhibit a triboelectric charge of a polarity opposite to that of the charge patterns to be developed. As described hereinbelow, under the control of the logic and control unit L, the developer stations 22*a*–22*c* are actuated to bring their associated marking particles into contact with corresponding image-wise charge patterns so that the marking particles adhere to the image areas to respectively develop the patterns with the appropriately colored marking particles. That is, the image-wise charge pattern corresponding to the red color separation image is developed with cyan marking particles, the charge pattern corresponding to the green color separation image is developed with magenta marking particles, and the charge pattern corresponding to the blue color separation image is developed with yellow marking particles. Of course, other schemes for producing color developed images are suitable for use with this invention.

The marking particle developed images are sequentially transferred in accurate superimposed register to a receiver member (e.g., a cut sheet of plain bond paper) to form a multi-color reproduction of the information to be reproduced. To effect the transfer operation, a receiver member is transported from a receiver member supply stack 24*a* (or 24*b*) to a transfer device 26. The transfer device 26 is for example an electrically biased transfer roller of the type shown in U.S. Pat. No. 4,724,458, issued Feb. 9, 1988, in the name of Roy et al. The receiver member is tacked to the transfer device 26 and, in timed relation with the passage of the web areas bearing the developed images, presented by the device in nip relation with the web to transfer the marking particles in superimposed register thereto.

After the transfer of the last of the successive marking particle images to the receiver member, the receiver member is detacked from the transfer device 26 and transported to a fixing apparatus 28 where the marking particles are fused to the receiver member by heat and/or pressure for example. The receiver member bearing the multi-color reproduction is then delivered to an output hopper 30 for operator retrieval. While the marking particles are being fixed to the receiver member, the web continues to travel about its closed loop path through a cleaning mechanism 32 where any residual marking particles are removed, and then returned to the vicinity of the charger 18 where the cleaned area is ready for reuse in the reproduction process.

Figure 2:
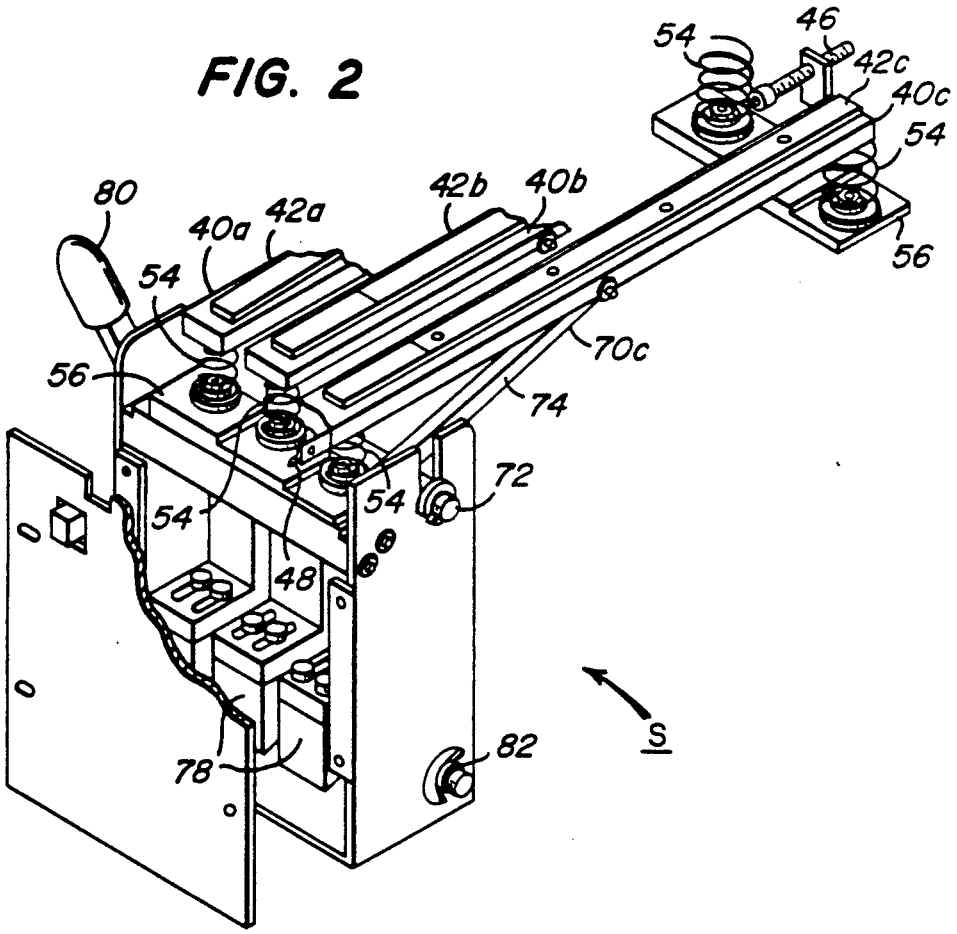
FIG. 2 is a view in perspective, on an enlarged scale, of the development station support assembly, with portions broken away or removed to facilitate viewing.
Figure 3:
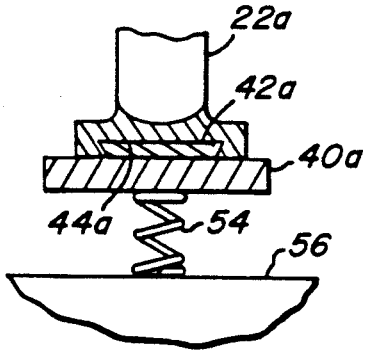
FIG. 3 is a side elevational view, on an enlarged scale, of the latch for the development station support assembly.

Turning now to the development station support assembly S of this invention, such support assembly is intended to both facilitate insertion and removal of the development stations 22*a*–22*c* and accurately position such stations relative to the web 12 during the reproduction operation. As best seen in FIG. 2, the support S includes a plurality of elongated members 40*a*–40*c*, extending in a direction transverse to the direction of movement of the web 12. The elongated members respectively have particularly shaped slide elements 42*a*–42*c* mounted thereon. The slide elements 42*a*–42*c* mate with complementary shaped slide channels respectively formed in the bases of the housings of the development stations 22*a*–22*c* (see representative developer station 22*a* including channel 44*a* as best shown in FIG. 3). The complementary shapes are, for example, that of a dovetail interface. Thus, each development station can be readily moved, independently, in and out of the development station support assembly S when it is desired to change such station for example.

Figure 4:
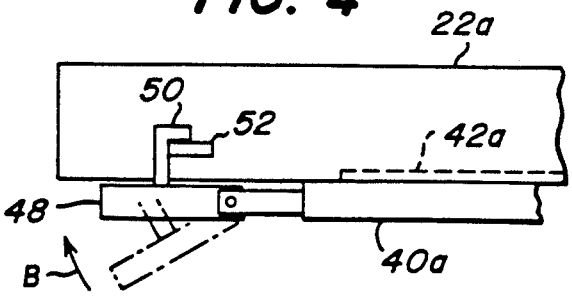
FIG. 4 is a front elevational view, on an enlarged scale, of the slide mounting of a development station on the development station support assembly.
Figure 8A:
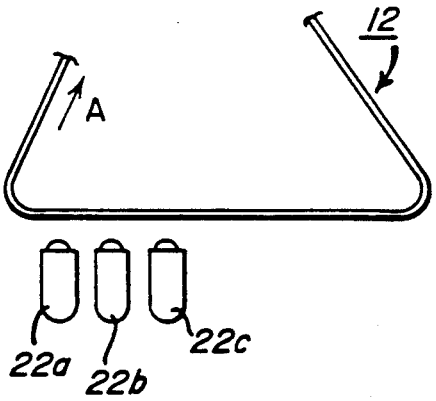
FIGS. 8*a*–8*f* are schematic representations showing the sequence of operation for the development stations relative to a dielectric member for making a multi-color reproduction.
Figure 8D:
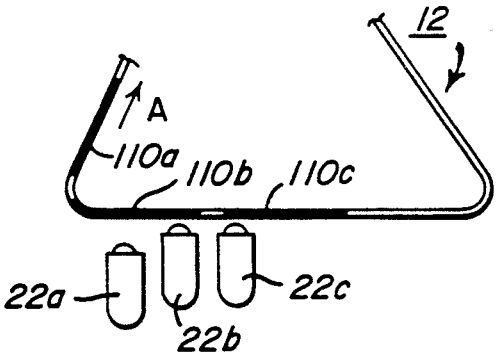
Figure 8B:
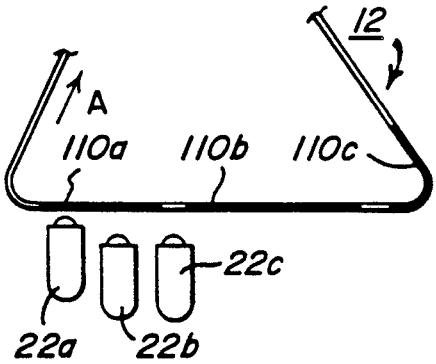
Figure 8E:
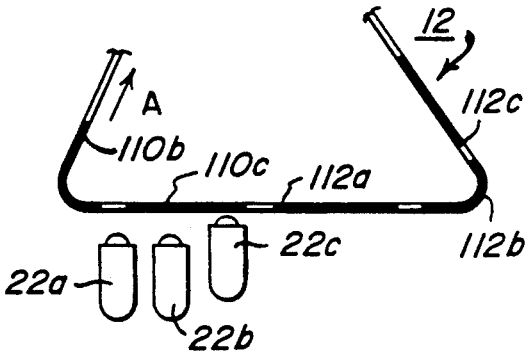
Figure 8C:
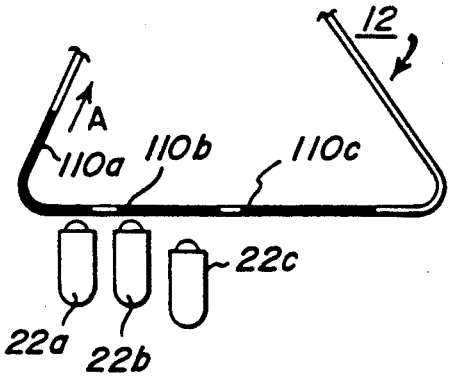
Figure 8F:
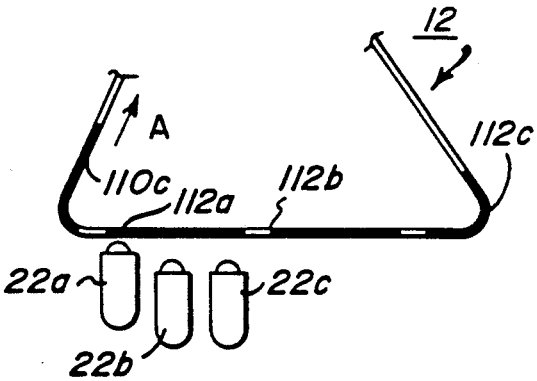

Adjustable screws 46 (one shown in FIG. 2), attached to each of the elongated members 40a–40c adjacent to the rear end thereof, serve as rear stops for the development stations 22a–22c to accurately locate the stations independently in the sliding direction as they are respectively received by the elongated members. Latch mechanism 48 (one shown in FIG. 2), attached to each of the elongated members 40a–40c adjacent to the front end thereof, serve to prevent movement of the respective development stations in the sliding direction during the reproduction operation. As shown in FIG. 4, each of the latch mechanisms 48 have a pivotably mounted retainer element 50 resiliently urged in the direction of arrow B. The element 50 is manually moved, against the urging force, out of the sliding path of a development station as such station is inserted or removed from the development station support assembly S. After such station is fully inserted into the support assembly, the element 50 is released to enable it to move, under its resilient urging force, into engagement with a feature 52 on the development station housing. By such engagement, the development station is prevented from movement on its associated slide element relative to the elongated member.

The elongated members 40a–40c are respectively supported adjacent to their ends by springs 54 mounted on a base surface 56 of the support assembly S (see FIGS. 5a and 5b). The springs 54 urge the elongated members 40a–40c, and thus the respective development stations 22a–22c slidably received by the elongated members, in a substantially vertical direction toward the web 12. This enables the support assembly S to define a compact arrangement with the development stations. The dielectric member supporting core 60 of the reproduction apparatus 10 has a plurality of front stops 62 and rear stops 64 fixed thereto and accurately located relative to the plane of the run of the web through the development zone. As best seen in FIG. 7a, when otherwise unrestricted, the housing of the development stations 22a–22c (one shown) will engage the front and rear stops under the urging forces of the springs 54 so as to be oriented parallel to the plane of the web. The utilization of the springs 54 adjacent to the ends of the development station supporting elongated members has a distinct advantage in that it enables the development stations to independently self-align, in the cross track direction, with the web to assure proper spacing of each respective station with the web.

In order to enable the development stations 22a–22c to be readily changed without damaging the web 12, the development stations are movable simultaneously, as a unit, by the support assembly S to a position remote from the web. To accomplish such movement, a plurality of levers 70a–70c are supported on a pivot shaft 72 mounted on the support assembly S (see FIGS. 2, 5a, and 5b). The levers 70a–70c respectively comprise a pair of arms 74 and 76 extending in substantially opposite directions from the pivot shaft 72. The arms 74 are respectively coupled at their outboard ends to the plurality of elongated members 40a–40c at substantially the mid-points thereof; and the arms 76 have wedge-shaped cam followers 78 respectively fixed thereto adjacent to their outboard ends. A handle 80 is fixed on a shaft 82 mounted in the support assembly S. The shaft 82 has a plurality of cams 84 fixed thereto, such cams being located along the shaft in association with the plurality of cam followers 78 respectively.

As best seen in FIG. 5a, when the handle 80 is in its substantially vertical position, the cams 84 are oriented so that their defined profiles enable the levers 70 to assume the position where the elongated members 40a–40c are solely under the urging influence of the springs 54. As such, the elongated members locate development stations 22a–22c, respectively received by the elongated members against the front and rear stops 62, 64 (see FIG. 7a). To move the development stations simultaneously to their position remote from the web 12, the handle 80 is moved to the position shown in FIG. 5b. In such position, the shaft 82 is rotated to orient the cams 84 so that, due to their defined profiles, the cams act on the cam followers 78 to move the levers 70a–70c in a counterclockwise direction about the pivot shaft 72. Movement of the levers causes the arms 74 to act on the elongated members 40a–40c to move the elongated members (and thus the development stations) simultaneously against the urging of springs 54 to the remote position. Since the arms 74 are respectively coupled to the elongated members at substantially the mid-points thereof, the elongated members remain in their orientation substantially parallel to the web as they move away from the web to the remote position. At the remote position, the development stations can be individually replaced without coming into potentially damaging contact with the web 12.

As noted above, in order to make multi-color reproductions, sequential image-wise charge patterns on the web 12 are developed with different color marking particles from the development stations 22a–22c. To assure that a particular charge pattern is developed with only the appropriate color marking particles, the development stations 22a–22c must be independently movable in proper timed relationship into and out of operative association with the web 12. Accordingly, the development stations, which are normally urged by springs 54 into engagement with the stops 62, 64 where the marking particles are in developing contact with the web 12 (see FIG. 7a), must be held in a position (see FIG. 7b) where the marking particles are in non-contact with the web except during the time when a particular image-wise charge pattern is to be developed by contact with such marking particles.

In order to accomplish the selective holding of the development stations in the non-contact relation with the web 12, an articulating mechanism including a plurality of independently actuatable cam pairs 90a–90c are provided (see FIG. 6). The plurality of cam pairs are mounted on a plurality of shafts 92a–92c respectively, the shafts being in turn supported by the core 60 of the reproduction apparatus 10. An assembly 94 serves to drive the cam pairs. The drive assembly 94 includes a continuously rotating main drive shaft 96 interconnected with the shafts 92a–92c by a belt-and-pulley arrangement 98 through a plurality of clutches 100a–100c respectively. The clutches 100a–100c, under the control of the logic and control unit L, are independently actuated to selectively rotate the shafts 92a–92c, and thus the cam pairs 90a–90c. The cam pairs are normally in the position shown in FIG. 7b where they engage the housings of the development stations 22a–22c to maintain the stations a predetermined distance from the web 12. Such distance is selected so as to be sufficient to prevent marking particles in the development stations from being brought into developing contact with the web.

When a selected one of the clutches 100a–100c is actuated, rotation of the main shaft 96 is imparted to the respective shaft 92a–92c to rotate the associated cam pair mounted thereon approximately 180°. As a result such cam pair is located so as to be out of engagement with its associated development station housing, and the housing is urged by the springs 54 into its position in engagement with the stops 62, 64 (see FIG. 7*a*). In such position, the particular development station is located relative to the web 12 so that the marking particles are in developing contact with the web. FIGS. 8a–8f show the sequence of movement of the development stations 22a–22c relative to image-wise charge patterns 110a–110c (related to a first reproduction to be made) and patterns 112a–112c (related to a subsequent reproduction to be made) in order to appropriately develop such patterns with particular color marking particles for proper forming of developed images used in making the multi-color reproductions. Specifically, as image-wise charge pattern 110a of the first reproduction approaches the development area, station 22a is moved (in the above described manner) from its non-contact position relative to the web 12 (see FIG. 8a) to its position in developing contact with with the web (see FIG. 8b) to develop the pattern 110a. As pattern 110b enters the development area and the trail edge of the pattern 110a passes beyond station 22b, station 22b is moved to its developing contact position to develop pattern 110b, with station 22a remaining in its developing contact position long enough to assure development of the trail edge of pattern 110a (see FIG. 8c). Once the trail edge of pattern 110a is developed, station 22a is moved to its non-contacting position. Similarly, as pattern 110c enters the development area and the trail edge of the pattern 110b passes beyond station 22c, station 22c is moved to its developing contact position to develop pattern 110c, with station 22b remaining in its developing contact position long enough to assure development of the trail edge of pattern 110b (see FIG. 8d). Once the trail edge of pattern 110b is developed, station 22b is moved to its non-contacting position (see FIG. 8e). Station 22c remains in its developing contact position long enough to assure development of the trail edge of pattern 110c and thereafter is moved to its non-contact position. As the image-wise charge pattern 112a of the first reproduction approaches the development area, station 22a is returned to its position in developing contact with the web (see FIG. 8f) to develop the pattern 112a and the described process is repeated until all image-wise charge patterns are developed by the appropriate respective development stations.

The invention has been described in detail with particular reference to the preferred embodiment thereof, but it will be understood that variations and modifications can be affected within the spirit and scope of the invention.

We claim:

1. In an electrostatographic reproduction apparatus having a plurality of development stations respectively containing different color marking particles for selective development of a plurality of latent image-wise charge patterns on a moving dielectric member, so that such apparatus is capable of making multi-color reproductions, a support assembly for said development stations, said support assembly comprising:

a plurality of members adapted to receive said plurality of development stations respectively, said plurality of members respectively including an elongated slide substantially parallel to said dielectric member and extending in a direction transverse to the direction of movement of said dielectric member;

means for simultaneously moving said elongated slides to a first position where development stations received on said elongated slides are remote from said dielectric member to facilitate removal of such development stations from said apparatus, and to a second position where such development stations are in juxtaposition with said dielectric member, said simultaneous moving means including a plurality of pairs of springs associated with said elongated slides respectively to act on said slides adjacent to the ends thereof, and a linkage coupled to each of said elongated slides at substantially the mid-point thereof so that, upon movement of said elongated slides by said linkage, said elongated slides remain substantially parallel to said dielectric member; and means for independently moving said elongated slides, once in said second position where development stations received on said elongated slides are located to bring marking particles into development contact with said dielectric member, to a third position where such development stations are located to prevent marking particles from coming into contact with said dielectric member.

2. The invention of claim 1 wherein said linkage means includes a plurality of levers coupled to said plurality of members respectively, a shaft pivotably supporting said plurality of levers, a plurality of cam followers connected to said plurality of levers respectively, a plurality of cams associated with said plurality of cam followers respectively, and actuating means connected to said plurality of cams for selectively moving said plurality of cams simultaneously against said plurality of cam followers.

3. The invention of claim 1 wherein said independent moving means includes means for urging said plurality of members in a direction toward said second position, stop means located relative to said dielectric member and said development stations received by said plurality of members for accurately positioning said development stations, under urging of said plurality of members by said urging means, in said second position in development contact with said dielectric member, a plurality of cams associated with the plurality of development stations respectively for moving such development stations against the urging of said urging means to said third position, and means for independently actuating said cams to independently control the location of each development station in either said second or third position.

4. The invention of claim 3 wherein said urging means includes a plurality of pairs of springs associated with said plurality of members respectively to act on each of said plurality of members adjacent to the ends thereof to enable said development stations, in engagement with said stop means, to independently self-align with said dielectric member.

5. In a multi-color electrostatographic reproduction apparatus having a plurality of development stations respectively containing different color marking particles for selective development of a plurality of latent image-wise charge patterns on a moving dielectric member, a support assembly for said development stations, said support assembly comprising:

a plurality of elongated slide members oriented substantially parallel to said dielectric member and extending in a direction transverse to the direction of movement of said dielectric member, each of said slide members having a cross-sectional configuration complementary to a corresponding channel-like cross-sectional configuration in the base of each of said development stations so as to enable said development stations to be respectively received by said slide members;

means for urging said plurality of slide members in a direction toward a position where such development stations are in juxtaposition with said dielectric member to bring marking particles into development contact with said dielectric member, said urging means including a plurality of pairs of springs associated with said elongated slides respectively to act on said slides adjacent to the ends thereof;

linkage means for selectively moving said plurality of slide members simultaneously, against the urging of said urging means, to a position where development stations received by said slide members are remote from said dielectric member to facilitate removal of such development stations from said apparatus, said linkage means being coupled respectively to each of said elongated slides at substantially the mid-point thereof so that, upon movement of said elongated slides by said linkage means, said elongated slides remain substantially parallel to said dielectric member; and means for independently moving said plurality of slide members, once in said second position, to a third position where such development stations are located to prevent marking particles from coming into development contact with said dielectric member.

6. The invention of claim 5 wherein said cross-sectional configuration is in the shape of a dovetail interface.

7. The invention of claim 5 wherein said independent moving means includes stop means located relative to said dielectric member and said development stations received by said plurality of slide members for accurately positioning said development stations, under urging of said slide members by said urging means, in said second position in development contact with said dielectric member, a plurality of cams associated with the plurality of development stations respectively for moving such development stations against the urging of said urging means to said third position, and means for independently actuating said cams to independently control the location of each development station in either said development contact or non-development contact position.

* * * * *